US008254823B2

(12) United States Patent
Nagashima et al.

(10) Patent No.: US 8,254,823 B2
(45) Date of Patent: Aug. 28, 2012

(54) WASTE TONER STORAGE UNIT AND IMAGE FORMING APPARATUS USING SAME

(75) Inventors: Hiroyuki Nagashima, Yokohama (JP); Shuji Tanaka, Chigasaki (JP); Nobuo Kuwabara, Yokohama (JP); Hiroshi Ono, Tokyo (JP); Ken Amemiya, Tokyo (JP); Masahiko Shakuto, Zama (JP); Toshio Koike, Kawasaki (JP); Yuji Arai, Kawasaki (JP); Michiya Okamoto, Zama (JP); Kenji Honjoh, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 630 days.

(21) Appl. No.: 12/250,079

(22) Filed: Oct. 13, 2008

(65) Prior Publication Data

US 2009/0097879 A1 Apr. 16, 2009

(30) Foreign Application Priority Data

Oct. 15, 2007 (JP) ..... 2007-268344
Jun. 19, 2008 (JP) ..... 2008-160010

(51) Int. Cl.
*G03G 21/12* (2006.01)

(52) U.S. Cl. ..... 399/360; 399/120

(58) Field of Classification Search ..... 399/360, 399/35, 120
See application file for complete search history.

(56) References Cited

U.S. PATENT DOCUMENTS 7,184,684 B2 * 2/2007 Murakami et al. ..... 399/110
2006/0193648 A1 * 8/2006 Kadowaki et al. ..... 399/13

FOREIGN PATENT DOCUMENTS

| | | |
|---|---|---|
| JP | 63-204265 | 8/1988 |
| JP | 2-85459 | 7/1990 |
| JP | 04-282649 | 10/1992 |
| JP | 08-054808 | 2/1996 |
| JP | 2005-037664 | 2/2005 |
| JP | 2005-096347 | 4/2005 |
| JP | 2005-189523 | 7/2005 |
| JP | 2007-241197 | 9/2007 |

OTHER PUBLICATIONS

Japanese Office Action issued May 19, 2012 in Japanese Application No. 2008-160010.

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A waste toner storage unit detachably mountable to an image forming apparatus includes a waste toner container and an inner cover integrally attached to the waste toner container. The waste toner container stores waste toner recovered after an image forming process. The inner cover is located at a region of the waste toner storage unit that does not store waste toner.

25 Claims, 13 Drawing Sheets

WASTE TONER STORAGE UNIT AND IMAGE FORMING APPARATUS USING SAME

CROSS-REFERENCE TO RELATED APPLICATIONS

This application claims priority under 35 U.S.C. §119(a) to Japanese Patent Application Nos. 2007-268344, filed on Oct. 15, 2007, and 2008-160010, filed on Jun. 19, 2008 in the Japan Patent Office, the entire contents of each of which are hereby incorporated by reference herein.

BACKGROUND OF THE INVENTION

1. Field of the Invention

The present disclosure generally relates to a waste toner storage unit for recovering waste toner, and an image forming apparatus having a waste toner storage unit detachably mountable to the image forming apparatus, such as a copier, a facsimile, a printer, a plotter, or a multifunctional apparatus.

2. Description of the Background Art

Recently, a size of image forming apparatuses using electrophotography becomes smaller and smaller with a trend of energy saving and occupying space saving, wherein such image forming apparatuses may be a copier, a facsimile, a printer, a plotter, or multifunctional apparatus having a plurality of functions. Such an image forming apparatus has a plurality of internally disposed units or internal parts therein, such as a container for recovering waste toner not used for an image forming operation (hereinafter, "waste toner bottle").

Although a size of the image forming apparatus becomes smaller, an amount of waste toner generated by an image forming process may not be reduced just by reducing the size of the image forming apparatus. Further, a user wants a waste toner bottle having a longer replacement cycle in view of usability of image forming apparatus. Accordingly, a size of the waste toner bottle may not become so small, and as a result, a relative occupying volume space of the waste toner bottle in an image forming apparatus becomes greater.

Further, in a conventional image forming apparatus, when an outer cover of an image forming apparatus is opened, a user may see an inner cover, which covers internal parts (e.g., steel plate, harness) so that the user does not see the internal parts, which may be a visually unattractive portion. Accordingly, the inner cover is used to enhance product appearance quality by providing a visually eye pleasing part inside the image forming apparatus.

In general, the above mentioned waste toner bottle is not devised as a visually eye pleasing part because the waste toner bottle is devised as a functional component. However, with a trend of enhancing product appearance quality even internal to the apparatus, the waste toner bottle may also need to be designed as a visually eye pleasing part. Conventionally, an outer cover and waste toner bottle of an image forming apparatus may be coupled to each other by an interlock mechanism. When such outer cover is opened, a waste toner bottle may also be separated or disengaged from an internal structure of the image forming apparatus. Accordingly, such a waste toner bottle may not be used as an inner cover, and a user that opens the outer cover may see the internal structure, which is not visually eye pleasing, and thereby product appearance quality of the image forming apparatus may not be pleasantly perceived.

Further, with a trend of an increased size of the waste toner bottle, a distribution equalization part, such as paddle, may need to be installed inside the waste toner bottle to evenly distribute recovered toner in the waste toner bottle. However, once the waste toner bottle is sealed by a cover after installing parts in the waste toner bottle, it becomes difficult to check whether parts are suitably installed in the waste toner bottle. If such internal checking is not easily conducted, defectively assembled products may be shipped. Further, with a trend of a relatively increased size of the waste toner bottle, a total cost of using the waste toner bottle may undesirably increase if the waste toner bottle may be discarded as a disposable unit once the waste toner bottle is filled with waste toner, and such discarding may not be environment friendly.

SUMMARY OF THE INVENTION

According to an aspect of the present disclosure, a waste toner storage unit detachably mountable to an image forming apparatus includes a waste toner container and an inner cover integrally attached to the waste toner container. The waste toner container stores waste toner recovered after an image forming process. The inner cover is located at a region of the waste toner storage unit that does not store the waste toner.

In another aspect of the present disclosure, an image forming apparatus includes an image forming unit, and a waste toner storage unit detachably mountable to the image forming apparatus. The image forming unit uses toner particles for image forming. The waste toner storage unit includes a waste toner container and an inner cover integrally attached to the waste toner container. The waste toner container stores waste toner recovered after an image forming process. The inner cover has is located at a region of the waste toner storage unit that does not store the waste toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
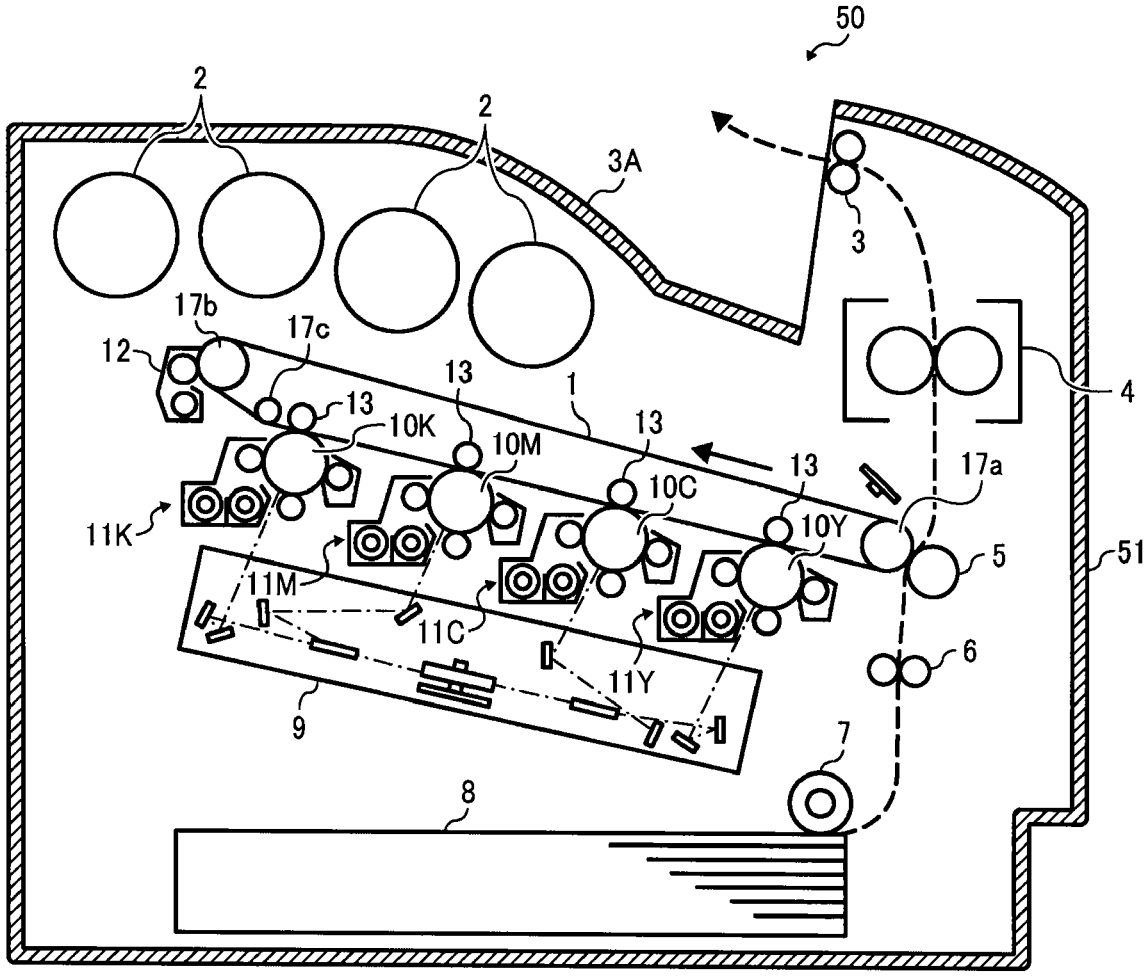
FIG. 1 illustrates a schematic configuration of an image forming apparatus according to exemplary embodiments.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF THE EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Figure 2:
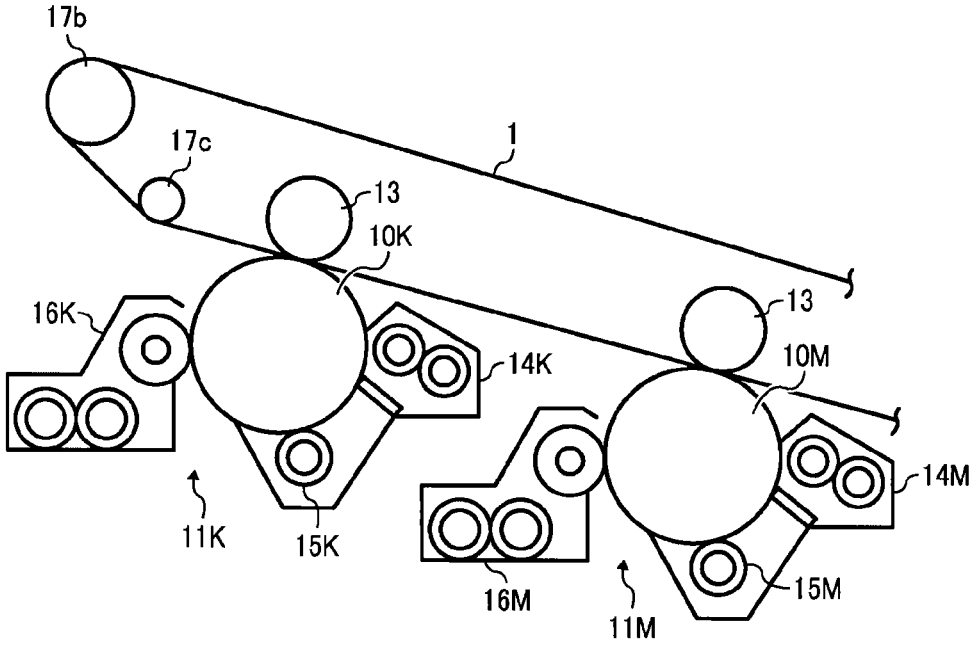
FIG. 2 illustrates a schematic configuration around a process cartridge used in the image forming apparatus of FIG. 1.

Referring now to the drawings, an image forming apparatus employing a waste toner container unit according to an exemplary embodiment is described with respect to FIGS. 1 and 2. The image forming apparatus may employ electrophotography, for example, but is not limited thereto.

FIG. 1 illustrates a schematic configuration of an image forming apparatus according to an exemplary embodiment, and FIG. 2 illustrates an expanded view around an image forming unit used in the image forming apparatus of FIG. 1. As illustrated in FIG. 1, an image forming apparatus 50 has a frame body 51, which schematically includes an inner and outer structure of the image forming apparatus 50. The image forming apparatus 50 may be a color printer, for example, but is not limited thereto. As illustrated in FIGS. 1 and 2, the image forming apparatus 50 includes an intermediate transfer belt 1, a toner cartridge 2, a sheet ejection roller 3, a sheet ejection tray 3A, a fixing unit 4, a secondary transfer roller 5, a registration roller 6, a sheet feed roller 7, a sheet cassette 8, an optical writing unit 9, image carrying members 10K, 10M, 10C, 10Y, a process cartridge 11, a belt cleaning unit 12, and a primary transfer roller 13, for example.

In the image forming apparatus 50, the intermediate transfer belt 1, extended/supported by a plurality of rollers 17*a*, 17*b*, and 17*c*, travels in a given direction (e.g., an arrow direction in FIG. 1). The process cartridges 11K, 11M, 11C, and 11Y are disposed in tandem under the intermediate transfer belt 1 while respective image carrying members 10K, 10M, 10C, and 10Y are contacted to a surface of the intermediate transfer belt 1. Because the image carrying members 10K, 10M, 10C, and 10Y have a similar configuration to one another, the image carrying members 10K, 10M, 10C, and 10Y may be referred as the image carrying member 10, hereinafter. The image carrying member 10 may be a photoconductor having a drum shape, for example. An electrostatic latent image formed on the image carrying member 10 is developed as a toner image, and the toner image is then transferred from the image carrying member 10 to the intermediate transfer belt 1 at a primary transfer nip set between the image carrying member 10 and the primary transfer roller 13. The process cartridge 11 includes the image carrying member 10, a development unit 16, a cleaning unit 14, and a charge roller 15, for example. The process cartridge 11 is detachably mountable to the frame body 51, for example.

As illustrated in FIGS. 1 and 2, the image carrying member 10 is surrounded with the cleaning unit 14, the charge roller 15Y, and the development unit 16, for example. Such a configuration is similarly employed for each of the process cartridges 11K, 11M, 11C, and 11Y. Black (K), magenta (M), cyan (C), and yellow (Y) toner are supplied to each of the process cartridges 11K, 11M, 11C, and 11Y from the toner cartridge 2 at a given timing.

Further, the optical writing unit 9 is disposed under the process cartridge 11K, 11M, 11C, and 11Y. The optical writing unit 9 includes a light source, a polygon scanner unit, and other optical parts, for example. The light source may be a laser diode (LD) prepared for each color, the polygon scanner unit includes a polygon mirror having several (e.g., six) reflection faces and a polygon motor, and the other optical parts may be a lens or a mirror disposed along a light path of light, such as a f-theta lens, and a cylindrical lens, for example. A laser beam emitted from the laser diode is deflected by the polygon scanner unit and scanned on the image carrying members 10K, 10M, 10C, and 10Y.

The primary transfer roller 13 faces the image carrying member 10 via the intermediate transfer belt 1. The primary transfer roller 13 transfers a toner image from the image carrying member 10 to the intermediate transfer belt 1. Further, the secondary transfer roller 5 faces the roller 17*a* via the intermediate transfer belt 1. When a recording medium (e.g., transfer sheet) passes a nip between the secondary transfer roller 5 and the intermediate transfer belt 1, toner in the form of an image on the intermediate transfer belt 1 is transferred to the recording medium.

After such transfer process by the secondary transfer roller 5, the belt cleaning unit 12 removes toner particles remaining on the intermediate transfer belt 1. Similarly, the cleaning unit 14 removes toner particles remaining on the image carrying member 10 after transferring a toner image from the image carrying member 10 to the intermediate transfer belt 1.

The sheet cassette 8 stores transfer sheets, for example, sheets of paper. The transfer sheet is transported from the sheet cassette 8 to the registration roller 6 using the sheet feed roller 7. The registration roller 6 feeds the transfer sheet to the nip formed by the secondary transfer roller 5 at a given timing to transfer toner images from the intermediate transfer belt 1 to the transfer sheet. The registration roller 6 feeds the transfer sheet when a sensor detects a feed timing of transfer sheet.

A description is now given of an image forming process in the image forming apparatus 50. When the transfer sheet is transported to the registration roller 6 using the sheet feed roller 7, a sensor detects such sheet transported to the registration roller 6. Then, based on a sheet detection signal of the sensor, the registration roller 6 feeds the transfer sheet to the nip set by the secondary transfer roller 5 and the intermediate transfer belt 1 at a given timing to transfer toner images from the intermediate transfer belt 1 to the transfer sheet.

The charge rollers 15K, 15M, 15C, and 15Y uniformly charge the respective image carrying members 10K, 10M, 10C, and 10Y, and the optical writing unit 9 scans laser beams on the charged image carrying members 10K, 10M, 10C, and 10Y to form electrostatic latent images on the image carrying members 10K, 10M, 10C, and 10Y which may be implemented as photoconductive drums or belts, for example. The development units 16K, 16M, 16C, and 16Y respectively develop electrostatic latent images on the image carrying members 10K, 10M, 10C, and 10Y as toner images.

Then, a transfer bias voltage is supplied to the primary transfer roller 13 to sequentially transfer toner images from the image carrying members 10K, 10M, 10C, and 10Y onto the intermediate transfer belt 1. Such a transfer process at each of the image carrying members 10K, 10M, 10C, and 10Y is conducted with a given time interval so as to transfer toner images of each color at a same position on the intermediate transfer belt 1. The toner image formed on the intermediate transfer belt 1 is then secondarily transferred to the transfer sheet by the secondary transfer roller 5. The transfer sheet is further transported to the fixing unit 4 to fix the toner image on the transfer sheet by applying heat and pressure, and then ejected to the sheet ejection tray 3A by the sheet ejection roller 3.

After such toner image transfer process, the cleaning unit 14 cleans toner remaining on the image carrying member 10, and the belt cleaning unit 12 cleans toner remaining on the intermediate transfer belt 1.

Figure 3:
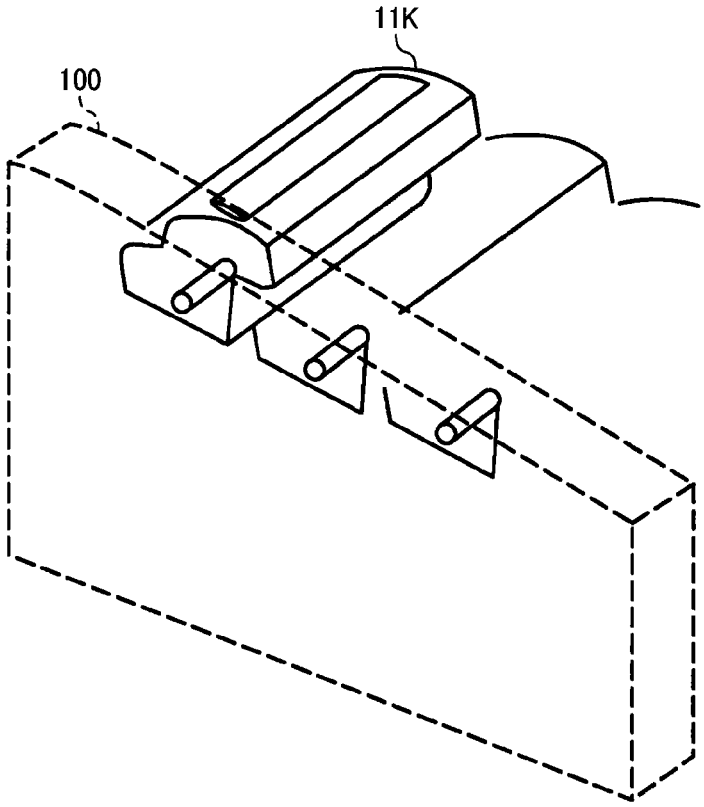
FIG. 3 illustrates a perspective view of relative positions of a process cartridge and a waste toner recovering section in the image forming apparatus of FIG. 1.

The toner cleaned or recovered by such cleaning process is referred to as waste toner in this description. The waste toner is ejected to a waste toner recovering section 100 shown in FIG. 3 from the cleaning unit 14 via a waste toner transport tube and a waste toner ejection port of the process cartridge 11. The waste toner recovering section 100 is disposed in the image forming apparatus 50. Alternatively, instead of ejecting the waste toner to the waste toner recovering section 100 from the process cartridge 11 directly, the waste toner may be transported to a waste toner transport path in the image forming apparatus 50 and then transported to the waste toner recovering section 100.

Figure 4:
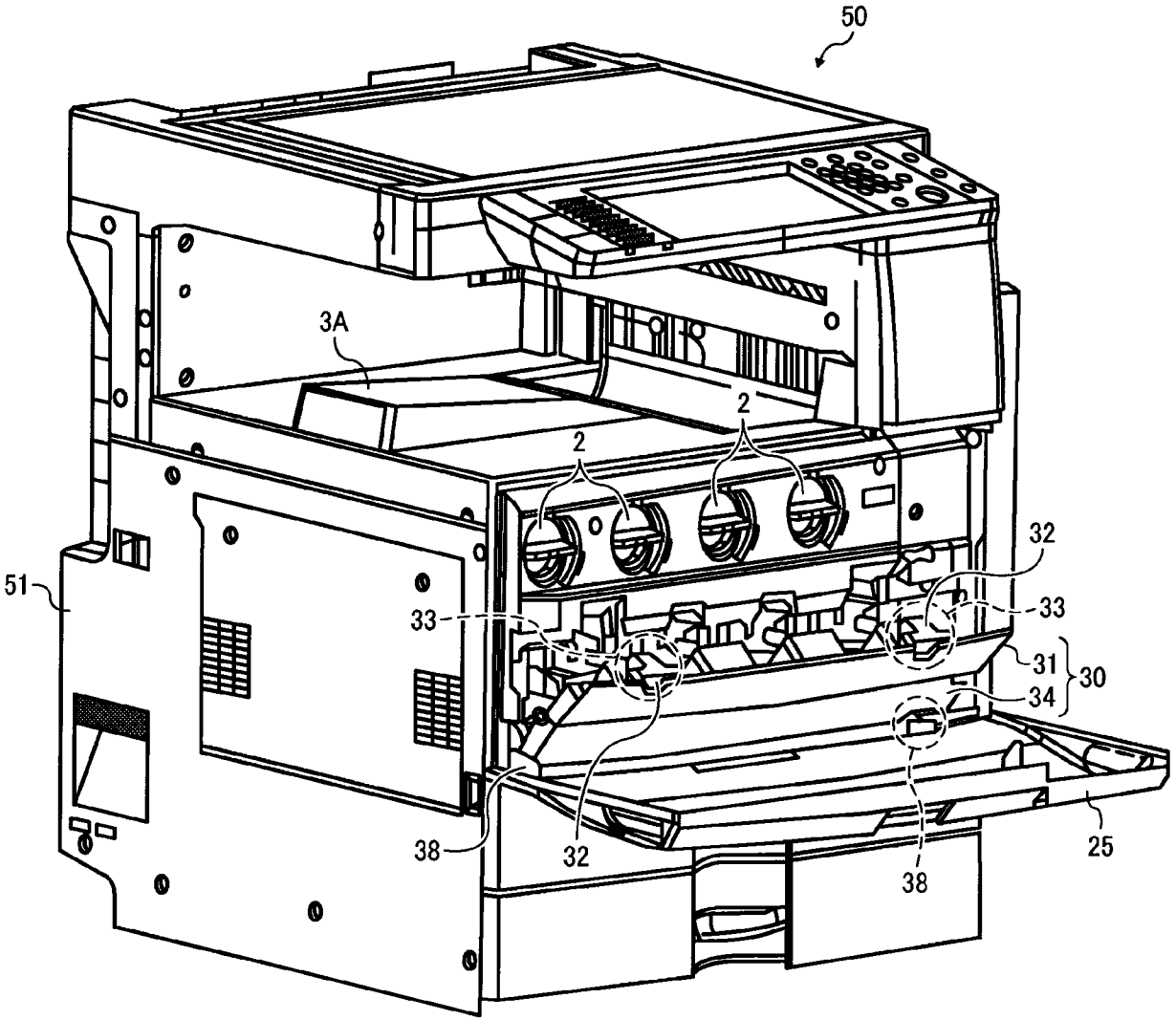
FIG. 4 illustrates a perspective view of an image forming apparatus according to a first exemplary embodiment, in which a waste toner storage unit is detachably mountable.
Figure 5:
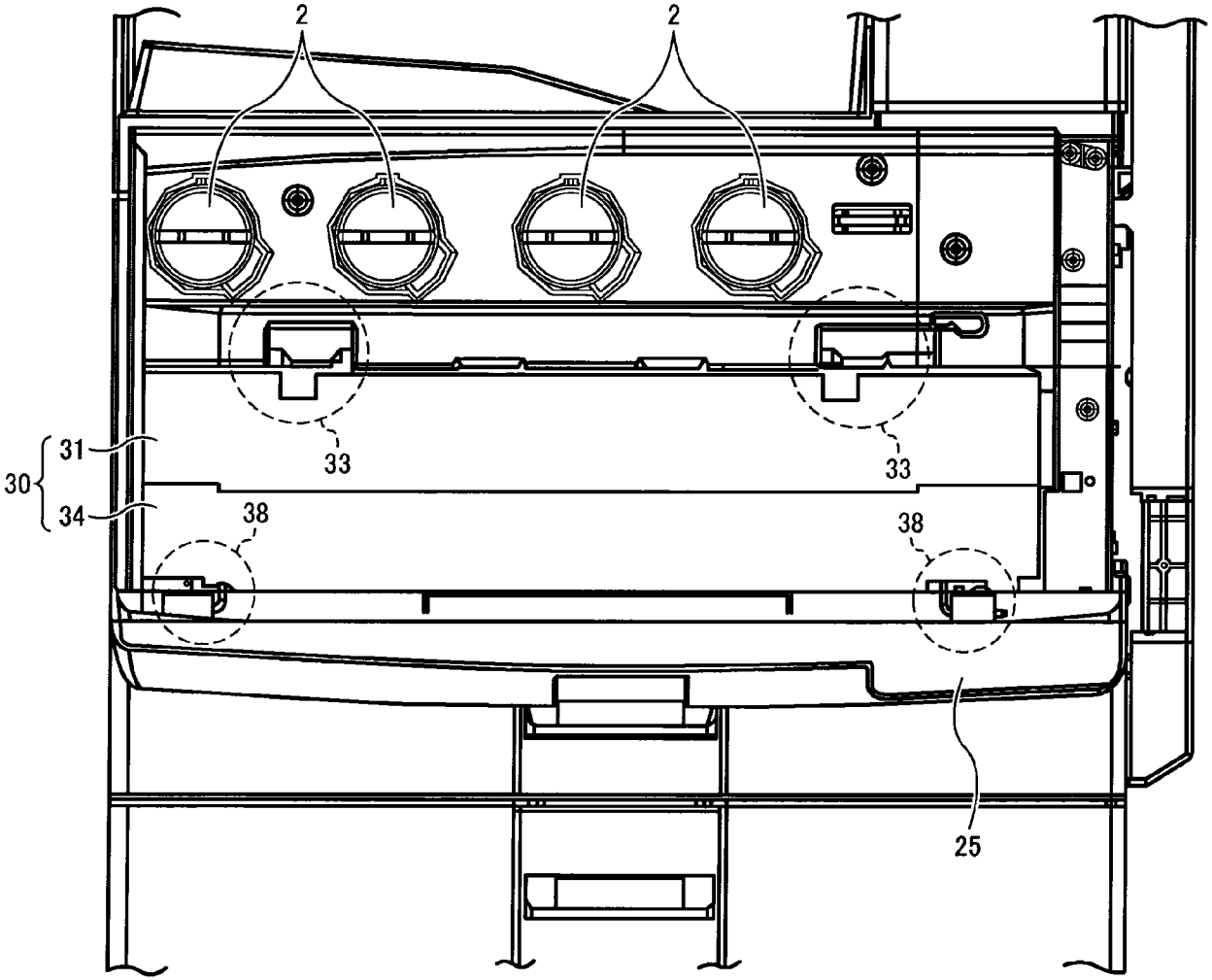
FIG. 5 illustrates a front view of the image forming apparatus of FIG. 4, in which a front outer cover is opened to view an inner structure of the image forming apparatus.
Figure 6:
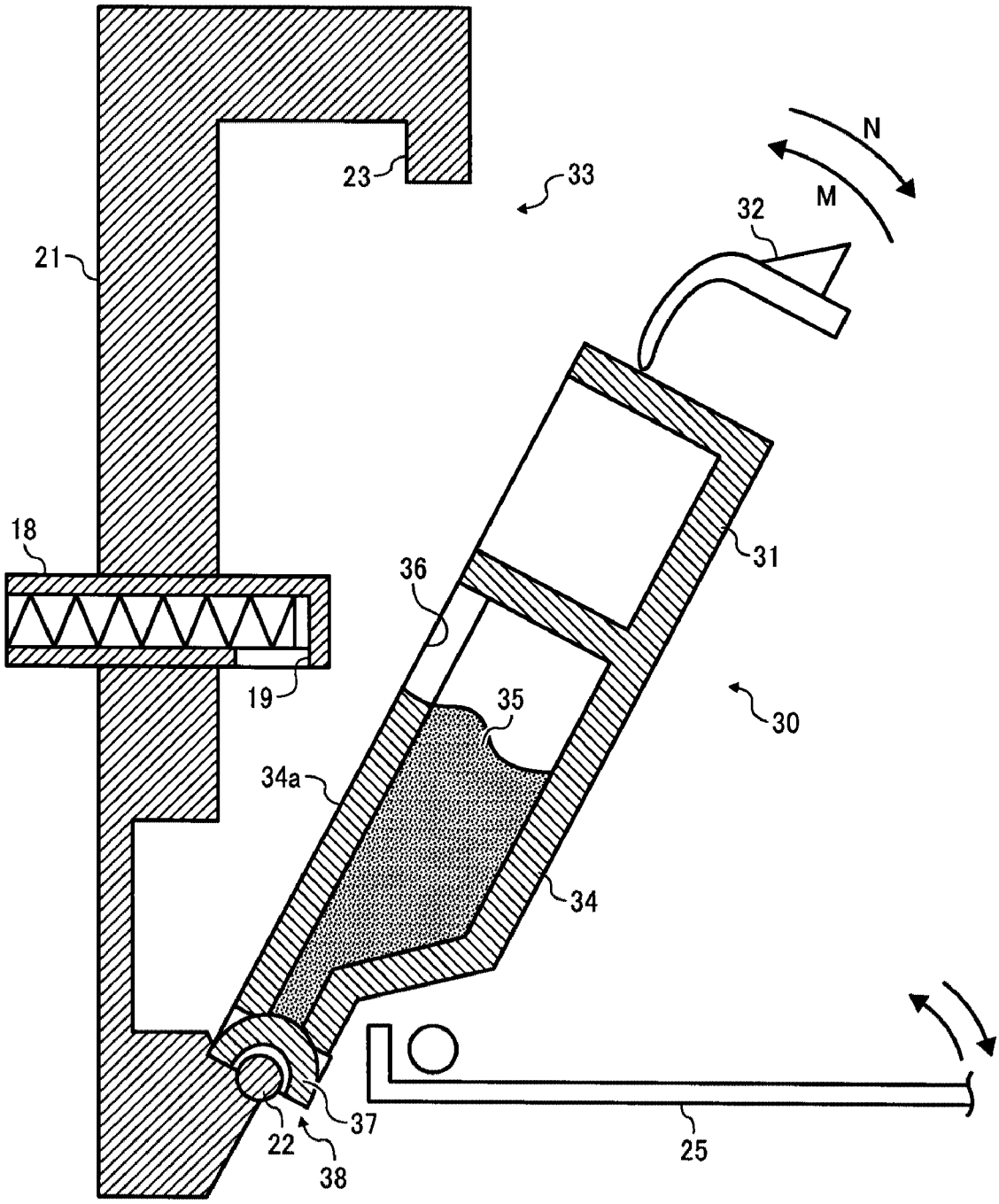
FIG. 6 illustrates a cross sectional view of a waste toner storage unit, according to an exemplary embodiment, detachably mountable to the image forming apparatus of FIG. 4.

A description is now provided of a waste toner storage unit 30 according to a first exemplary embodiment with reference to FIGS. 4 to 6. FIG. 4 illustrates a state that the waste toner storage unit 30 is detached from the frame body 51, and FIG. 5 illustrates a state that the waste toner storage unit 30 is mounted to the frame body 51. As illustrated in FIGS. 4 to 6, the waste toner storage unit 30 includes a waste toner container 34, an inner cover 31, and a back cover 34*a*, for example. The waste toner container 34 contains waste toner 35 recovered from the process cartridge 11, wherein the waste toner 35 includes toner particles recovered from the image carrying member 10, such as a photoconductor, after an image forming process. The inner cover 31, which itself has no function of recovering or containing the waste toner 35, is integrated with the waste toner container 34. For example, the inner cover 31 is integrated at an upper side of the waste toner container 34 as illustrated in FIG. 6. The inner cover 31 can occupy any amount of space, but is preferably 5% to 50% of the front area occupied by the waste toner container 34, and is more preferably 10% to 40% of this front area. Further, the inner cover is preferably greater than 10% of the front area of the waste toner container 34, and is more preferably 25% or greater than the front area.

The waste toner storage unit 30 may be formed of a resin material to achieve a light weight and have a given preferable shape. For example, the waste toner storage unit 30 is shaped into a housing shape. Further, the back cover 34*a* may be welded to the waste toner container 34, by which the waste toner storage unit 30 can be used as a hermetically-sealed container for collecting waste toner or the like. The waste toner storage unit 30 may be manufactured by a molding method, for example.

The back cover 34*a* has a connection port 36 which fits with a waste toner transport tube 18 having an ejection port 19 as shown in FIG. 6. The waste toner transport tube 18 may be directly or indirectly connected to the process cartridge 11. When the waste toner transport tube 18 is inserted into the connection port 36, the ejection port 19 can be positioned inside the waste toner container 34. Accordingly, the waste toner 35 can be transported from the process cartridge 11 to the waste toner storage unit 30.

As above-mentioned, the inner cover 31 having no function of recovering or storing waste toner is integrated in the waste toner storage unit 30. FIG. 5 shows a state in which a front outer cover 25 is opened from the frame body 51, and the waste toner storage unit 30 has a function of storing waste toner and also a function of an inner cover which covers an internal part(s) of the image forming apparatus 50. Because the waste toner storage unit 30 is integrally formed with the inner cover 31 and the waste toner container 34, a product appearance quality of internal space of the image forming apparatus 50 can be enhanced. Further, such configuration can reduce the number of parts because parts used for a conventional inner cover can be omitted. If the number of parts can be reduced, a manufacturing cost of the image forming apparatus 50 can be reduced and assembly can be conducted efficiently (e.g., a lesser number of assembly steps). As such, the waste toner storage unit 30, including an integrated configuration of the inner covers 31 and the waste toner container 34, can cover internal parts in the image forming apparatus 50. The front outer cover 25 can be pivotably opened and closed.

Further, as illustrated in FIG. 6, the waste toner storage unit 30 includes a pivot point 38 at a bottom side of the waste toner storage unit 30, and a snap fitting mechanism 33 at an upper side of the waste toner storage unit 30. The waste toner storage unit 30 can pivotally move about the pivot point 38, and the waste toner storage unit 30 can be attached and fixed to a front frame 21 of the frame body 51 using the snap fitting mechanism 33. Further, in an exemplary embodiment, the waste toner storage unit 30 has a center of gravity at a relatively higher level. Specifically, because the waste toner storage unit 30 has the inner cover 31 above the waste toner container 34, the center of gravity of the waste toner storage unit 30 can be set higher than a center of gravity of the waste toner container 34 alone.

As illustrated in FIG. 6, the pivot point 38 is configured with a shaft 22, attached to the front frame 21, and a shaft receiver 37. The shaft receiver 37, shaped in a half-moon ring shape for example, is disposed at a bottom of the waste toner container 34 and at both lateral end portions of the waste toner container 34, for example. The shaft receiver 37 is attached to the shaft 22 at both lateral end portions of the waste toner container 34, for example.

The snap fitting mechanism 33 includes a projection member 32, and a projection stopper 23, for example. The projection member 32, made of a resin having a given elasticity, is formed in a given shape and fixed on an upper part of the inner cover 31 of the waste toner storage unit 30. The projection stopper 23 is formed in a given shape and fixed on an upper part of the front frame 21. Such projection member 32 can be snap fitted to the projection stopper 23 of the front frame 21 by using elasticity of the projection member 32.

The waste toner storage unit 30 is mounted to the front frame 21 of the frame body 51 as below. The shaft receiver 37 of the waste toner storage unit 30 is fit to the shaft 22 of the front frame 21. Then, the waste toner storage unit 30 is pivoted about the pivot point 38 in a direction shown by an arrow M in FIG. 6 by pushing the inner cover 31 in an upward direction.

When the projection member 32 is elastically fitted to the projection stopper 23 of the front frame 21, the waste toner storage unit 30 can be mounted in a given position in the frame body 51. Specifically, the ejection port 19 of the waste toner transport tube 18 can be set in the connection port 36 of the waste toner container 34. When the waste toner storage unit 30 is adequately mounted in the frame body 51, the projection member 32 is elastically fitted to the projection stopper 23, by which a user can recognize a click feeling which indicates to the user that the waste toner storage unit 30 is properly mounted in the frame body 51.

Further, the waste toner storage unit 30 has a center of gravity at a relatively higher level as above described. Because the waste toner storage unit 30 has the inner cover 31 above the waste toner container 34, the center of gravity of the waste toner storage unit 30 can be set higher than the center of gravity of the waste toner container 34 alone. The center of gravity of the waste toner storage unit 30 can be set higher by providing a relatively large-sized inner cover 31 on the waste toner container 34.

With such a configuration, the waste toner storage unit 30 can be disengaged from a mounted position easily by disengaging a locking condition of the snap fitting mechanism 33. Specifically, the projection member 32 is disengaged from the projection stopper 23 when disengaging the waste toner storage unit 30 from the front frame 21 of the frame body 51. Once the projection member 32 is disengaged from the projection stopper 23, the waste toner storage unit 30 can smoothly pivot about the pivot point 38 in a direction shown by an arrow N (a clockwise direction) in FIG. 6, opposite to a direction shown by the arrow M (a counter-clockwise direction), because of a higher center of gravity of the waste toner storage unit 30. With such a pivoting movement, the waste toner storage unit 30 can automatically drop to a given side, such as a front side of the image forming apparatus 50. Therefore, a user can easily conduct a removal operation of the waste toner storage unit 30 at the front side of the image forming apparatus 50. On one hand, if the waste toner storage unit 30 has the center of gravity at a lower level, such automatic falling operation may not be devised.

Figure 7A:
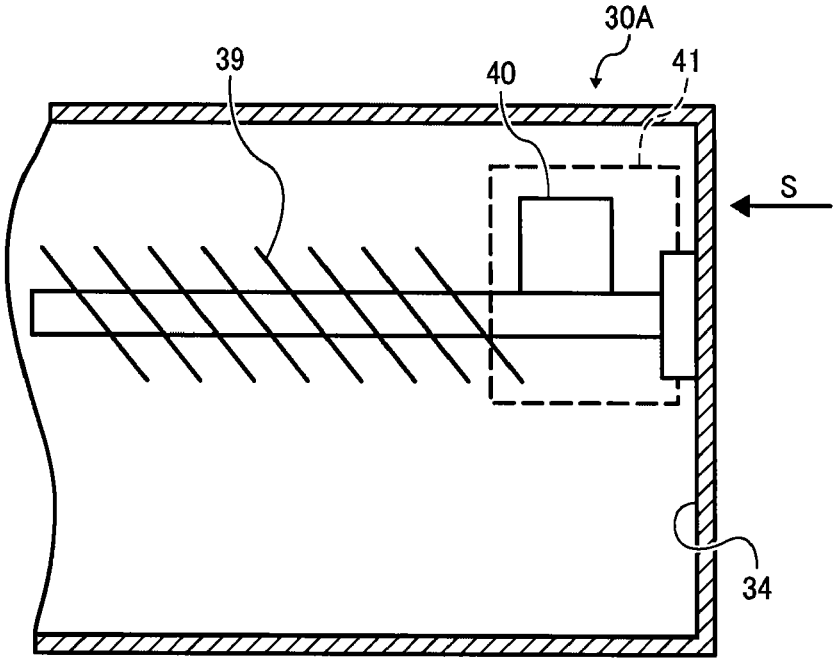
FIG. 7A illustrates a cross sectional view of another waste toner storage unit according to another exemplary embodiment having a check window on a waste toner container.
Figure 7B:
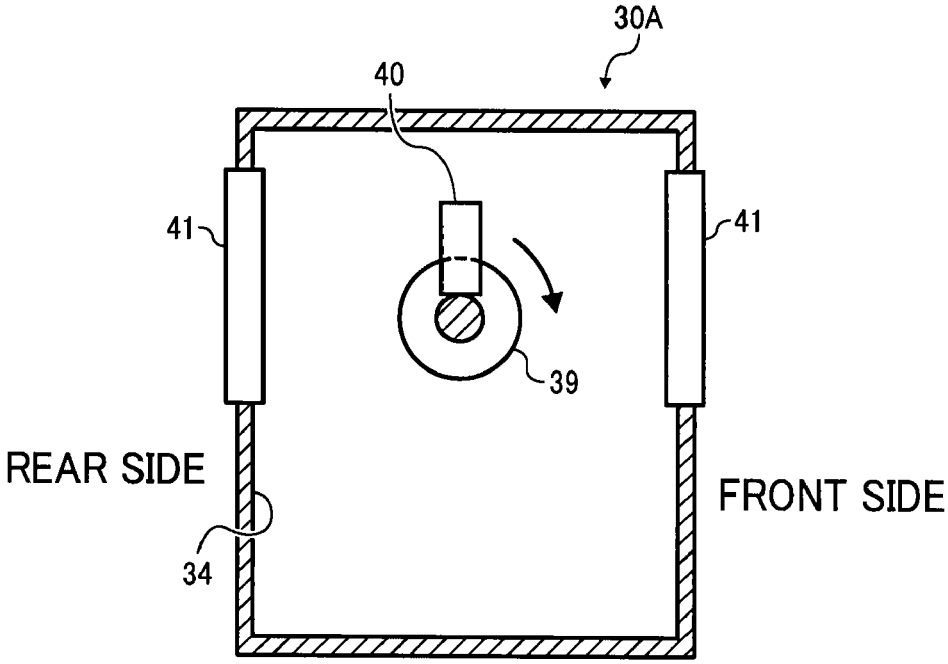
FIG. 7B illustrates a cross sectional view of the waste toner storage unit of FIG. 7A viewed from a direction S.

A description is now given to a modification of the first exemplary embodiment with reference to FIGS. 7A and 7B. In FIG. 7A and FIG. 7B, some parts are omitted to depict the waste toner container in a simplified manner. A waste toner storage unit 30A of FIGS. 7A and 7B have a different configuration for a waste toner container compared to the waste toner storage unit 30 of FIGS. 4 to 6. Specifically, the waste toner storage unit 30A has the waste toner container 34 having a check window 41. The check window 41 may be a transparent window made of a transparent resin such as for example methacrylic resin. However, the check window 41 may not need to be completely transparent but may be translucent. The check window 41 can be effectively used as a window for checking a condition inside the waste toner container 34 if the check window 41 has a given level of transparency.

Some image forming apparatuses may have a larger waste toner storage unit. If the waste toner storage unit becomes greater, an operability of the waste toner storage unit may need to be considered. For example, such a waste toner storage unit may include a part(s) to distribute waste toner equally within the waste toner storage unit, and such a part(s) may need to be assembled appropriately.

As illustrated in FIGS. 7A and 7B, the waste toner storage unit 30A has a transport screw 39, and a paddle 40 in the waste toner container 34. The waste toner storage unit 30A may further includes a toner sensor, which senses a toner full condition. The transport screw 39 and the paddle 40 are used to agitate waste toner accumulated in the waste toner container 34 to effectively distribute the waste toner 35 within the waste toner container 34. In other words, the transport screw 39 and the paddle 40 are used as distribution equalization members to evenly distribute waste toner in the waste toner container 34. If such a distribution equalization member is not utilized, waste toner may accumulate on a given local portion in the waste toner container 34, by which the waste toner container 34 is not effectively filled with the waste toner 35.

The waste toner container 34 used for the waste toner storage unit 30 or the waste toner storage unit 30A is sealed by the back cover 34*a* by a welding or bonding process after an internal part(s) (e.g., the transport screw 39, and/or the paddle 40) is set in a casing of the waste toner container 34. Accordingly, once the waste toner container 34 is sealed with the back cover 34*a*, it becomes difficult to check whether such internal parts are correctly assembled or not. If such internal parts are not assembled correctly, a defectively assembled product may be shipped.

To check an assembly condition in the waste toner container 34, the waste toner container 34 may include at least one check window 41. For example, the check window 41 may be disposed at a front side and a rear side of an image forming apparatus as shown in FIGS. 7A and 7B. In such a configuration, when the front outer cover 25 is opened, an internal part(s) is viewable through the check window 41 from the front side. Further, such an internal part is viewable through the check window 41 at the rear side. As such, if the check window 41 is disposed for the waste toner container 34, an assembly condition in the waste toner container 34 can be checked through the check window 41 at an assembly line in a factory or the like, even after the waste toner container 34 is sealed with the back cover 34*a*. Accordingly, a shipment of defectively assembled products can be prevented.

The check window 41 can be disposed any side of the waste toner storage unit 30A. For example, if enhanced product appearance quality is preferable, the check window 41 is disposed at the rear side, not viewable when the front outer cover 25 is opened, by which a user or operator may not see such check window 41. The number of check windows 41 disposed on the waste toner storage unit 30A is preferably one or more, although such a feature is optional and the number may be zero. If one window is not enough for checking inside the waste toner storage unit 30A, another window may be utilized.

Figure 8:
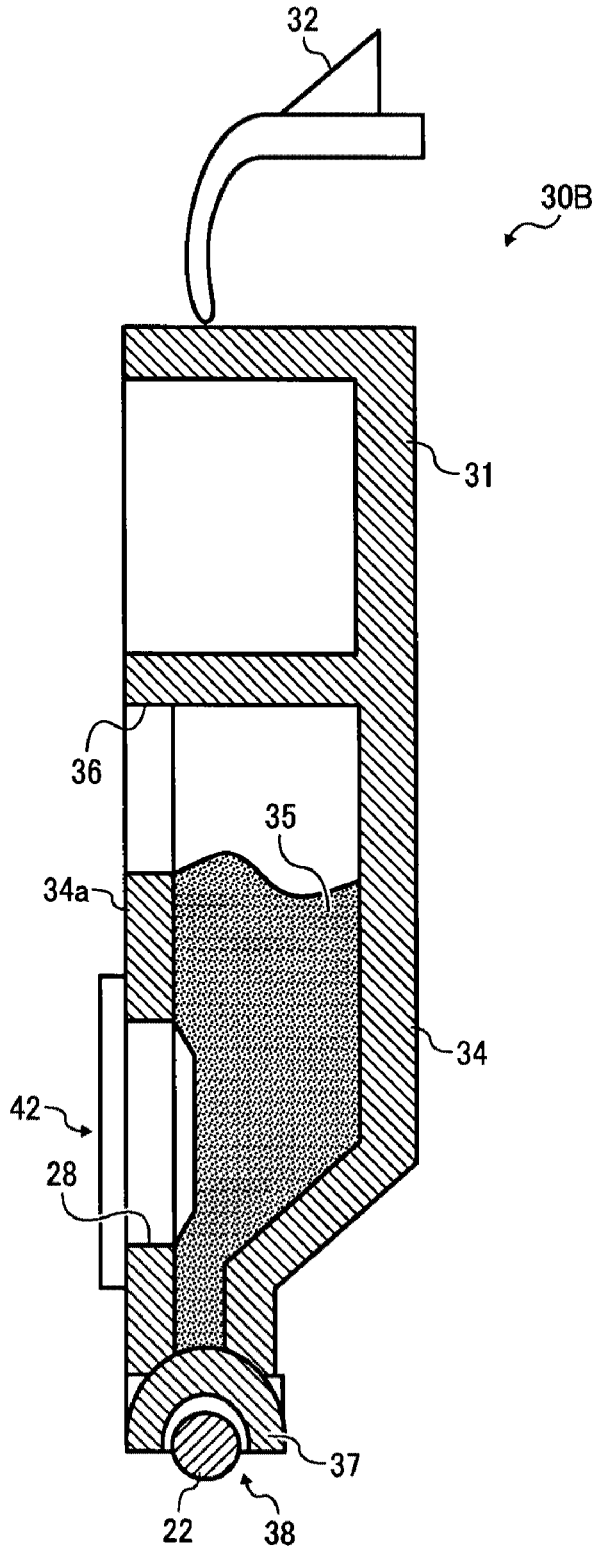
FIG. 8 illustrates a cross sectional view of another waste toner storage unit according to another exemplary embodiment having a cap, disposed at a rear side of the waste toner storage unit, for removing waste toner.
Figure 9A:
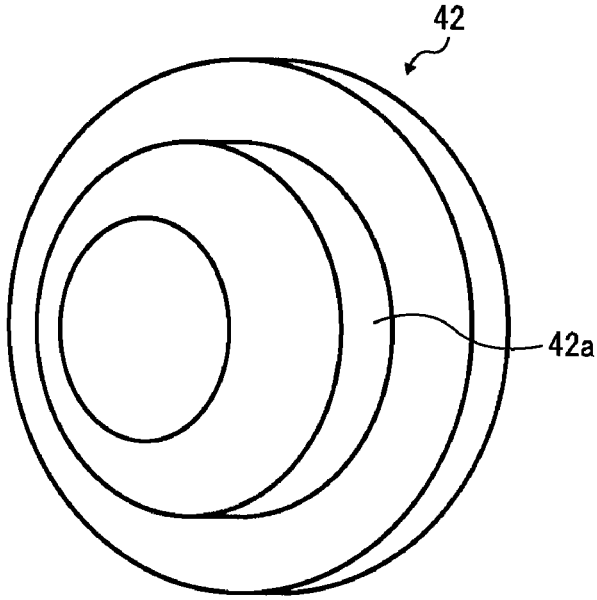
FIG. 9A and FIG. 9B illustrate a perspective and side view of the cap shown in FIG. 8.
Figure 9B:
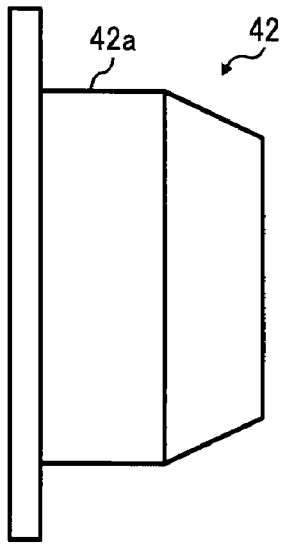

A description is now given to another modification for the first exemplary embodiment with reference to FIGS. 8 and 9. A waste toner storage unit 30B of FIG. 8 has another configuration for a waste toner container compared to the waste toner storage unit 30 of FIGS. 4 to 7. Specifically, the waste toner storage unit 30B has a cap 42 detachably connected to the waste toner storage unit 30B. The cap 42 can be opened or removed in order to eject the waste toner 35 from the waste toner storage unit 30B.

The previously described waste toner storage units 30 or 30A can reduce the number of parts composing a waste toner storage unit by integrally forming a waste toner container and an inner cover, by which a cost reduction can be achieved. However, if the waste toner storage units 30/30A are discarded as a disposable unit once the waste toner storage units 30/30A are filled with waste toner, a total cost of the waste toner storage units 30/30A may become high because such waste toner storage units 30/30A may be implemented to have a relatively large size. Further, discarding the waste toner storage units 30/30A may not be environmentally friendly. In view of such situation, the cap 42 detachably fits within a hole 28 of the waste toner container 34, as shown in FIG. 8. The hole 28 may be formed at a lower portion of the back cover 34*a*, for example. When the waste toner container 34 is filled with the waste toner 35, the cap 42 is uncapped to eject the waste toner 35 into a plastic bag, a waste container, or any other suitable device which can accept the waste toner. After removing the waste toner 35 from the waste toner container 34, a fitting face 42*a* (shown in FIGS. 9A and 9B) of the cap 42 is fitted to the hole 28. Accordingly, the waste toner storage unit 30B can be re-used a plurality of times, by which an environmental load caused by discarding the waste toner storage unit can be reduced.

Further, the cap 42 can be made of a transparent material, such as methacrylic resin, for example, and positioned at a given portion of the waste toner container 34. With such a configuration, internal parts in the waste toner container 34 can be checked from the outside of the waste toner container 34 through the cap 42. If such cap 42 having functions as a cap and a checking window is provided to the waste toner container 34, the above described check window 41 can be omitted, by which the number of parts can be reduced. As similar to the check window 41, such transparent cap 42 may not need to be completely transparent. The transparent cap 42 can be effectively used as a window for checking a condition inside the waste toner container 34, if the transparent cap 42 has a given level of transparency. Further, the cap 42 can be provided with a string attached to the waste toner container 34 to prevent the cap 42 from becoming lost when removed from the back cover 34*a*. Further, the cap 42 may be disposed as a shutter at a bottom of the back cover 34*a*, in which the shutter can be opened and closed to eject the waste toner.

Figure 10:
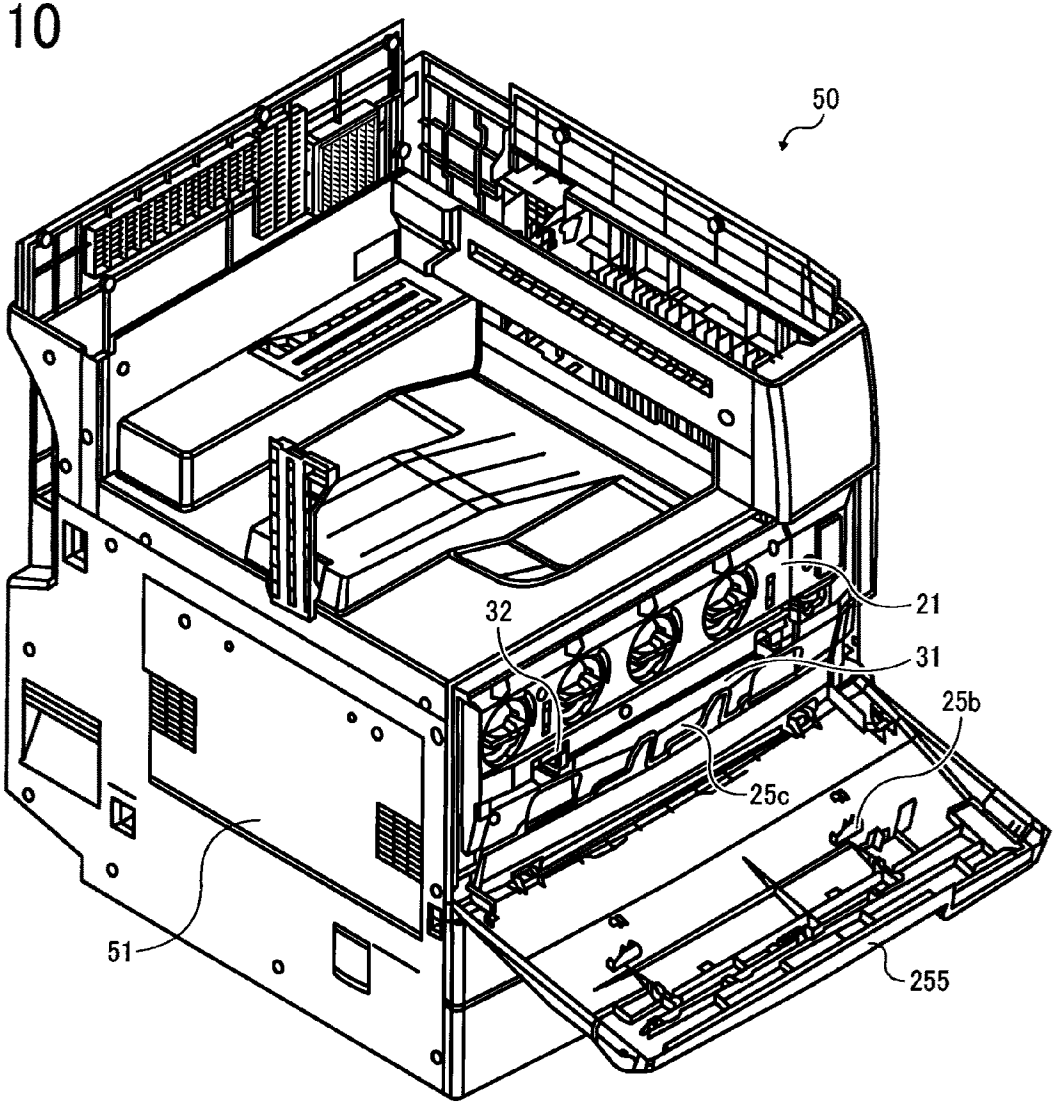
FIG. 10 illustrates a perspective view of an image forming apparatus according to a second exemplary embodiment, in which a waste toner storage unit is mounted in the image forming apparatus.
Figure 11:
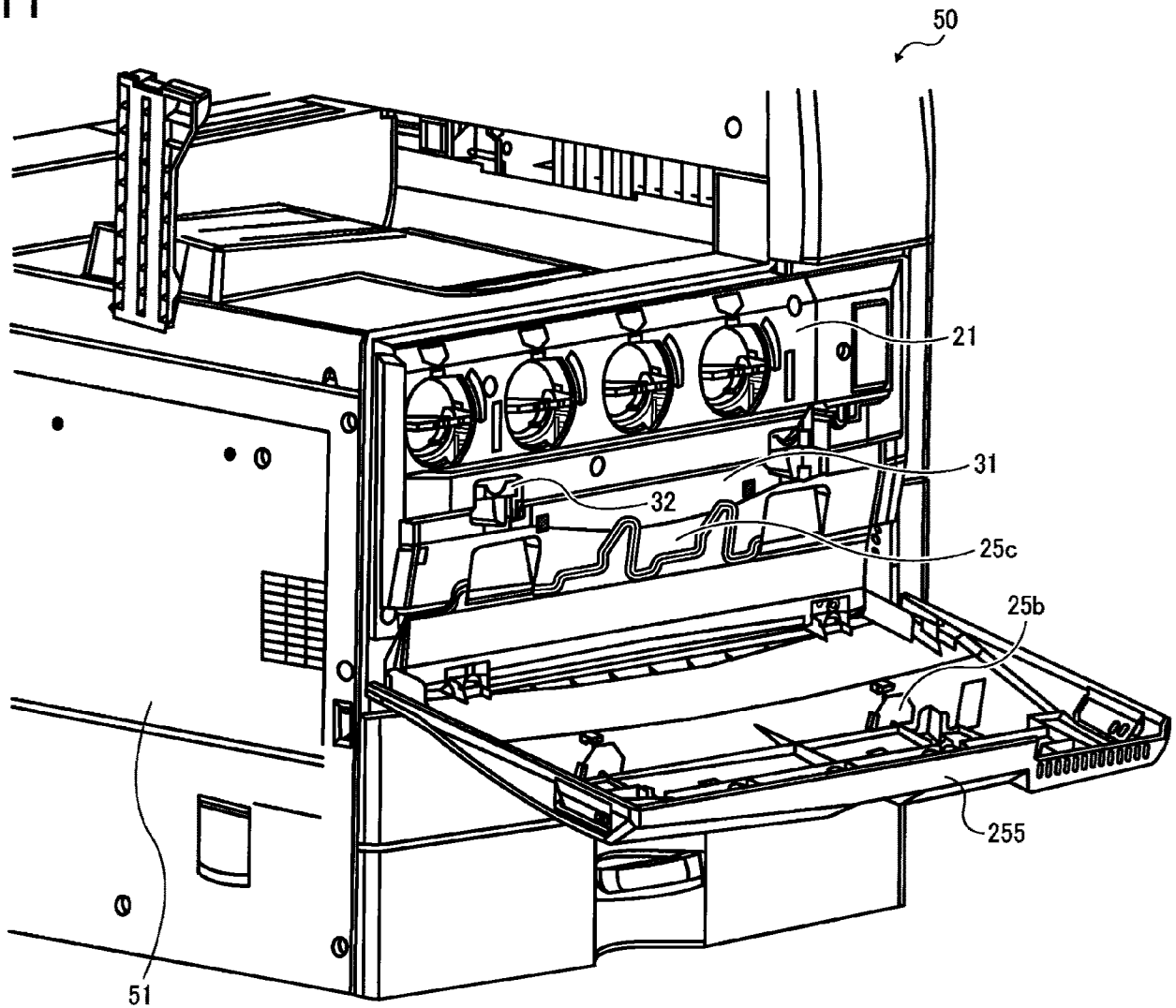
FIG. 11 illustrates a front view of the image forming apparatus of FIG. 10, in which a front outer cover is opened to view an inner structure of the image forming apparatus.

A description is now given to the second exemplary embodiment of an image forming apparatus with reference to FIGS. 10 to 14. FIG. 10 illustrates a perspective view of the image forming apparatus 50, in which a front outer cover 255 is opened. FIG. 11 illustrates an expanded view around the front outer cover 255 of FIG. 10.

Figure 12:
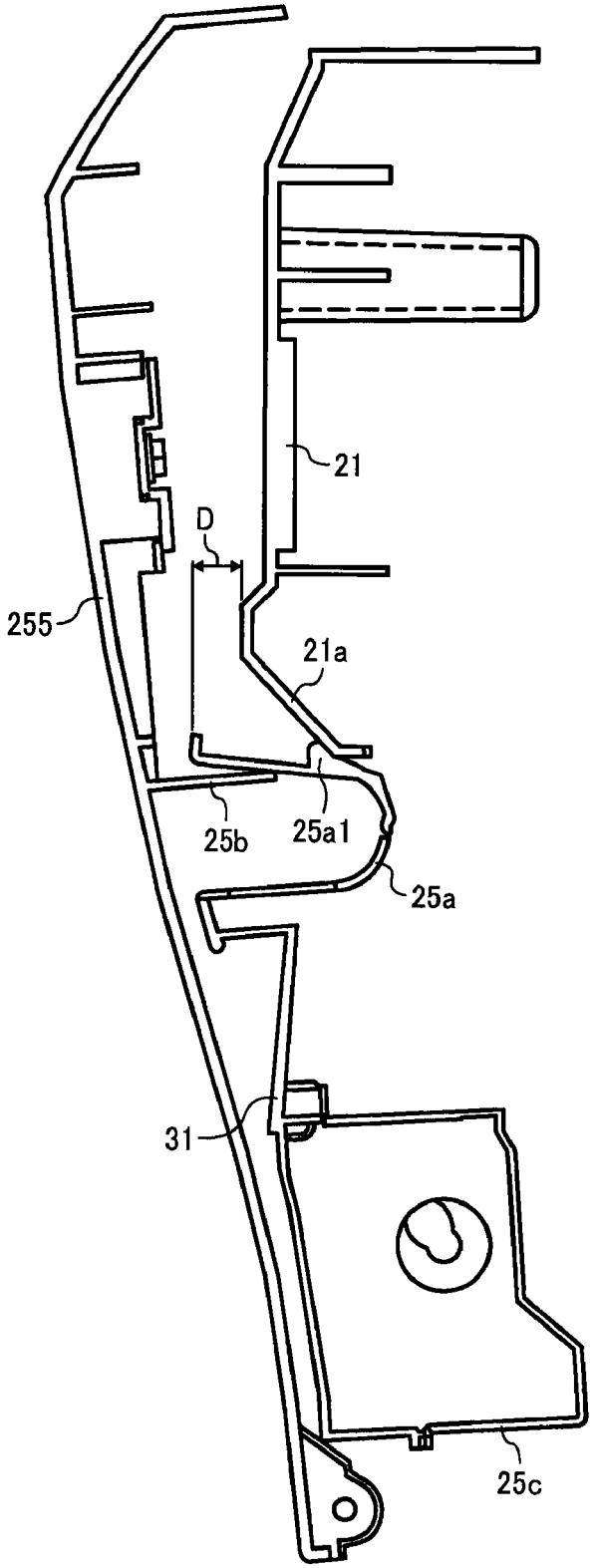
FIG. 12 illustrates a state that a pivoting movement of the front outer cover is inhibited when closing the front outer cover.

As shown in FIG. 12 the waste toner container 25*c* can be integrated with the inner cover 31. When the waste toner container 25*c* integrated with the inner cover 31 is mounted in the frame body 51, a part of surface of the front frame 21 and the inner cover 31 can be aligned substantially flat face each other to form an outer face of the frame body 51 as shown in FIGS. 10 and 11.

According to an exemplary implementation, the outer face has a good looking appearance, and the front frame 21 does not protrude from the inner cover 31, by which a space savings at the outer face can be attained. Further, because the front frame 21 and the inner cover 31 are set substantially flat with respect to each other, the front outer cover 255 covering the front frame 21 and the inner cover 31 can be formed in a flat shape, which is not a complex shape.

Further, as illustrated in FIG. 12, the waste toner container 25*c* has an engagement portion 25*a*, and the front frame 21 has a receiving portion 21*a*. The engagement portion 25*a* is extended from the waste toner container 25*c*.

When the waste toner container 25*c* is not completely mounted or set in the frame body 51, the engagement portion 25*a* does not engage the receiving portion 21*a* of the front frame 21 of the frame body 51. If the front outer cover 255 is to be closed from such mounting-incomplete condition, a projection portion 25*b* attached to an inner face of the front outer cover 255 is blocked by the engagement portion 25*a*, by which a closing (or pivoting) operation of the front outer cover 255 is stopped, and thereby the front outer cover 255 is not completely closed in the frame body 51.

Under such a movement inhibition state, the waste toner container 25*c* is not set in the frame body 51. Specifically, a small projection 25*a*1 of the engagement portion 25*a* having a U shaped form in cross section does not engage the receiving portion 21*a*, by which the front outer cover 255 is not completely closed. Accordingly, the image forming apparatus 50 may not be operated if the waste toner container 25*c* is not set to a normal position, and thereby an abnormal operation of the image forming apparatus 50 can be prevented.

Figure 13:
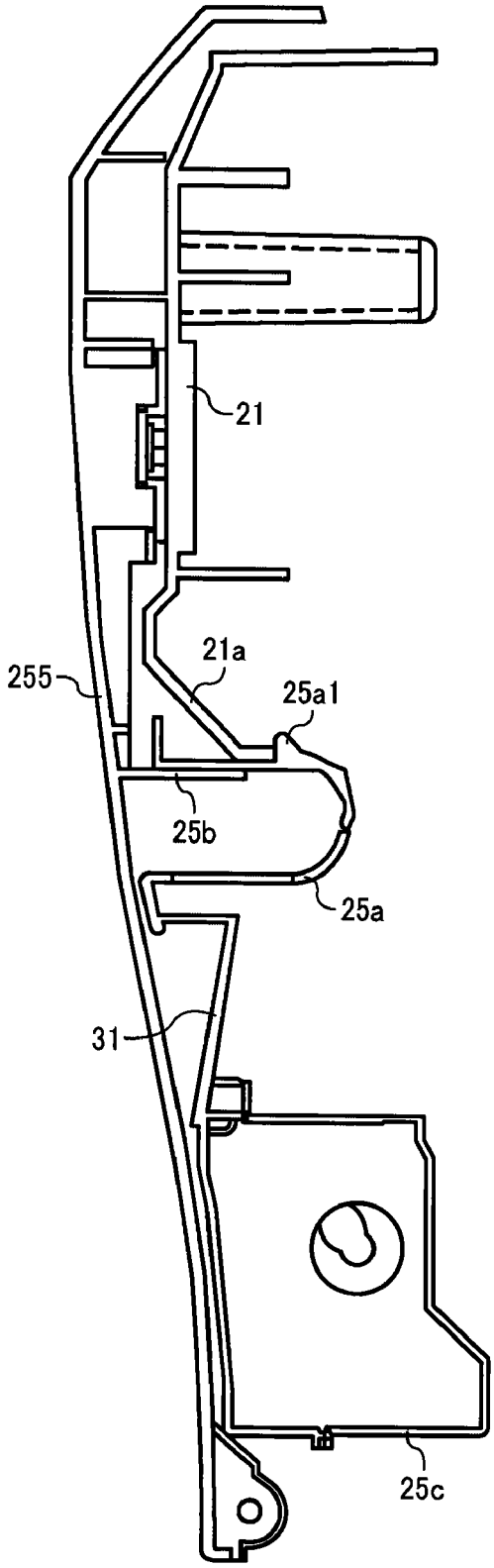
FIG. 13 illustrates a state that the front outer cover is closed to the image forming apparatus.

A description is now given to an opening/closing operation of the front outer cover 255 with reference to FIGS. 12 and 13. FIG. 13 illustrates a state in which the front outer cover 255 is closed, and in which the engagement portion 25*a* extended from the waste toner container 25*c* engages the receiving portion 21*a*. Specifically, the small projection 25*a*1, provided at a leading end of the engagement portion 25*a*, correctly engages the receiving portion 21*a*. When the small projection 25*a*1 correctly engages the receiving portion 21*a*, the projection portion 25*b* of the front outer cover 255 can be correctly set and placed in the engagement portion 25*a* having a U shaped cross-section.

In contrast, as illustrated in FIG. 12, when the waste toner container 25*c* is not set in the frame body 51 completely, the small projection 25*a*1 of the engagement portion 25*a* does not engage the receiving portion 21*a*, and the engagement portion 25*a* having a U shaped form in cross-section protrudes from the frame body 51 (see distance D in FIG. 12). If the front outer cover 255 is to be closed under such condition, the projection portion 25*b* of the front outer cover 255 may be blocked by the engagement portion 25*a*, and thereby the front outer cover 255 cannot be closed.

Although the projection portion 25*b* applies a given force to the engagement portion 25*a* even in such condition shown in FIG. 12, such a given force applied to the engagement portion 25*a* may not become so great to move the receiving portion 21*a* over the small projection 25*a*1. Specifically, a shape of the engagement portion 25*a* having a thin plate shape is designed to have a given shape so that the receiving portion 21*a* does not overcome the small projection 25*a*1 in a condition shown in FIG. 12.

A user (or operator) may manually correct the condition shown in FIG. 12 to set the waste toner container 25*c* in the frame body 51 completely as shown in FIG. 13.

A user can feel an engaging when the small projection 25*a*1 is about to engage the receiving portion 21*a* when the small projection 25*a*1 and the receiving portion 21*a* shifts from a condition from FIG. 12 to FIG. 13. Such feeling may be generated in a direction opposite to the closing direction of the front outer cover 255.

In FIG. 12, the small projection 25*a*1 is just about to be engaged with the receiving portion 21*a*, and the engagement portion 25*a* having a U shaped cross section is deformed and in an opened condition. Accordingly, when the engagement portion 25*a* is not contacting the receiving portion 21*a*, the U shaped form is deformed and opened. Such engagement portion 25*a* having flexibility may be a leaf spring, for example. In FIG. 12, the small projection 25*a*1 pushes a lower face of the receiving portion 21*a* while the engagement portion 25*a* is deformed by a given spring energy.

Figure 14:
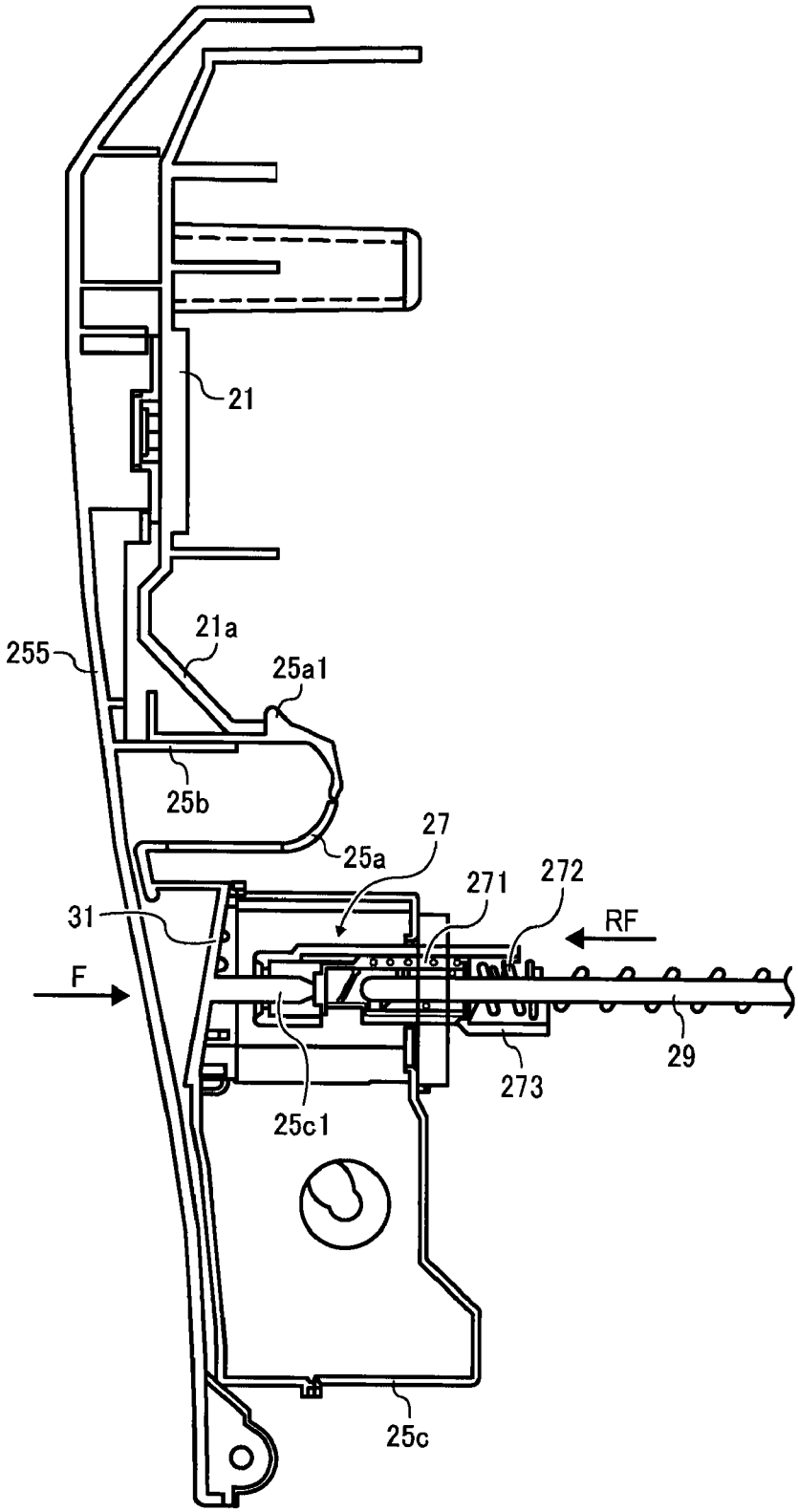
FIG. 14 illustrates a state that the front outer cover is engaged to and closed to the image forming apparatus with a reaction force generator.

Further, as illustrated in FIG. 14, the image forming apparatus 50 may include a reaction force generator 27, and a projection 25*c*1 for the waste toner container 25*c* so that a user can feel an engaging when the small projection 25*a*1 is to engage the receiving portion 21*a*. The reaction force generator 27 is used to generate a reaction force RF in a direction opposite to a closing force F of the front outer cover 255.

When the engagement portion 25*a* engages the receiving portion 21*a*, the projection 25*c*1, having a column shape for example, contacts the reaction force generator 27, by which the reaction force RF is generated in a direction opposite to the closing force F of the front outer cover 255. The reaction force generator 27 includes a slide member 271, a coil 272, and a housing 273, for example. The housing 273 houses the slide member 271 and the coil 272, in which one end of the coil 272 is fixed at a given position in the housing 273. When the projection 25*c*1 contacts the slide member 271, the slide member 271 moves in a given direction and then the coil 272 stops such movement of the slide member 271 elastically. Further, a toner conveying screw 29 is disposed inside the coil 272 to convey waste toner to the waste toner container 25*c*.

The above described waste toner storage units can be employed for image forming apparatuses having different configurations. For example, such image forming apparatus may employ an indirect transfer method using an intermediate transfer member, such as a belt and a drum member, or a direct transfer method using photoconductor and a transport belt, or such image forming apparatus may be a color image forming apparatus, and/or a monochrome image forming apparatus, but is not limited to any one of these implementations.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

The invention claimed is:

1. A waste toner storage unit detachably mountable to an image forming apparatus, comprising:

a waste toner container configured to store waste toner recovered after an image forming process;

a hole for receiving waste toner for the waste toner container; and a wall of the waste toner container being an inner cover for the image forming apparatus and having an extension beyond the waste toner container to conceal an interior of the image forming apparatus, wherein the hole is in a rear surface of the waste toner storage unit which is parallel to the inner cover.

2. The waste toner storage unit according to claim 1, further comprising:

a pivot device, disposed at a bottom of the waste toner storage unit, about which the waste toner storage unit pivots; and a fitting member, disposed at an upper part of the waste toner storage unit, configured to be fitted to a body of the image forming apparatus, wherein the extension is at an upper side of the waste toner container, when the waste toner container is in orientation in which the waste toner storage unit is installed in the image forming apparatus.

3. The waste toner storage unit according to claim 1, wherein the waste toner storage unit includes a transparent check window.

4. The waste toner storage unit according to claim 3, wherein the image forming apparatus has an outer cover, which is openable and closable, and the check window is disposed at a rear side of the waste toner storage unit such that the check window is not visible from a front side of the image forming apparatus when the outer cover is opened.

5. The waste toner storage unit according to claim 1, wherein the waste toner container has an open/close port to eject waste toner from the waste toner container.

6. The waste toner storage unit according to claim 5, wherein the open/close port comprises a transparent material and is positioned on the waste toner storage unit such that internal components of the waste toner storage unit are visible through the open/close port.

7. The waste toner storage unit according to claim 1, wherein:

the extension of the inner cover is greater than 10% of a front surface area of the waste toner container.

8. The waste toner storage unit according to claim 7, wherein:

the extension of the inner cover is greater than 25% of a front surface area of the waste toner container.

9. An image forming apparatus, comprising:

an image forming unit using toner for image forming;

the waste toner storage unit according to claim 1 for recovering toner from the image forming unit; and an outer which covers the inner cover.

10. The image forming apparatus according to claim 9, wherein the waste toner storage unit has a face portion which is aligned in a substantially flat face with a part of surface of a front frame of the image forming apparatus when the waste toner storage unit is mounted in the image forming apparatus.

11. The image forming apparatus according to claim 9, wherein:

the waste toner storage unit includes an engagement portion extended from the waste toner storage unit, and the image forming apparatus includes a receiving portion engage-able with the engagement portion, and the outer cover including a projection portion at an inner face of the outer cover, when the waste toner storage unit is not completely set in the image forming apparatus, the engagement portion does not engage the receiving portion completely, and when the outer cover is to be closed from such an incomplete engagement condition, the projection portion of the outer cover is blocked by the engagement portion of the waste toner storage unit to inhibit a closing operation of the outer cover.

12. The waste toner storage unit according to claim 1, wherein:

an interior of the waste toner container directly contacts an inside of the inner cover.

13. The waste toner storage unit according to claim 1, wherein:

the extension of the wall is above the waste toner container, when the waste toner container is in orientation in which the waste toner storage unit is installed in the image forming apparatus.

14. The image forming apparatus according to claim 9, wherein:

insertion and removal of supply toner containers of the image forming apparatus are from a side of the image forming apparatus at which the waste toner storage unit is located.

15. The image forming apparatus according to claim 14, wherein:

when the waste toner storage unit is attached to the image forming apparatus, a plane of the inner cover and the extension is parallel to a plane of a portion of the image forming apparatus at a region of the image forming apparatus through which the supply toner containers are inserted.

16. The waste toner storage unit according to claim 1, further comprising:

a pivot point about which the waste toner storage unit pivots; and a snap fitting mechanism at an upper side of the waste toner storage unit to engage with a frame of the image forming apparatus.

17. The waste toner storage unit according to claim 16, further comprising:

a back cover including a connection port for connection to a waste toner ejection port of the image forming apparatus, wherein:

the pivot point is disposed such that the waste toner storage unit is pivoted about the pivot point by pushing the inner cover in an upward direction, and the snap fitting mechanism includes a projection member which engages with a projection stopper of a frame of the image forming apparatus.

18. The waste toner storage unit according to claim 16, wherein:

the pivot point is disposed such that the waste toner storage unit is pivoted about the pivot point by pushing the inner cover in an upward direction, the snap fitting mechanism includes a projection member which engages with a projection stopper of a frame of the image forming apparatus, and only when the projection member is elastically fitted to the projection stopper of the frame, the waste toner storage unit can be mounted to the frame and a waste toner transport tube of the image forming apparatus can be set in a connection port of the waste toner container.

19. The waste toner storage unit according to claim 1, further comprising:

a cap, detachably connected to the waste toner container, at a hole in a lower section of the waste toner container.

20. The waste toner storage unit according to claim 1, wherein:

the extension is at a front side of the waste toner storage unit, relative to an orientation of the waste toner storage unit, when mounted in the image forming apparatus.

21. The waste toner storage unit according to claim 1, further comprising:

a snap fitting device, at a top of the waster toner storage unit and which is at a front side of the waste toner storage unit, relative to an orientation of the waste toner storage unit, when mounted in the image forming apparatus.

22. The waste toner storage unit according to claim 1, further comprising:

two snap fitting devices at a top of the waster toner storage unit, wherein the inner cover is between the two snap fitting devices.

23. The waste toner storage unit according to claim 1, wherein the extension comprises:

indented portions at a front side of the waste toner storage unit, relative to an orientation of the waste toner storage unit, when mounted in the image forming apparatus.

24. A waste toner storage unit detachably mountable to an image forming apparatus, comprising:

a waste toner container configured to store waste toner recovered after an image forming process;

a wall of the waste toner container being an inner cover for the image forming apparatus and having an extension beyond the waste toner container to conceal an interior of the image forming apparatus; and a pivot device, disposed at a bottom of the waste toner storage unit, about which the waste toner storage unit pivots.

25. The waste toner storage unit according to claim 24, wherein the waste toner container further comprises:

a back cover including a connection port for connection to a waste toner ejection port of the image forming apparatus.

* * * * *